US011359633B2

(12) United States Patent
Masutani et al.

(10) Patent No.: US 11,359,633 B2
(45) Date of Patent: Jun. 14, 2022

(54) CENTRIFUGAL COMPRESSOR WITH INTERMEDIATE SUCTION CHANNEL

(71) Applicant: MITSUBISHI HEAVY INDUSTRIES COMPRESSOR CORPORATION, Tokyo (JP)

(72) Inventors: Jo Masutani, Tokyo (JP); Hirofumi Higuchi, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 117 days.

(21) Appl. No.: 16/345,101

(22) PCT Filed: Feb. 19, 2018

(86) PCT No.: PCT/JP2018/005737

§ 371 (c)(1),
(2) Date: Apr. 25, 2019

(87) PCT Pub. No.: WO2018/151293

PCT Pub. Date: Aug. 23, 2018

(65) Prior Publication Data

US 2019/0285072 A1 Sep. 19, 2019

(30) Foreign Application Priority Data

Feb. 20, 2017 (JP) ..... JP2017-029167

(51) Int. Cl.
*F04D 17/12* (2006.01)
*F04D 29/42* (2006.01)
*F04D 29/44* (2006.01)

(52) U.S. Cl.
CPC ..... *F04D 17/12* (2013.01); *F04D 17/122* (2013.01); *F04D 29/4206* (2013.01);
(Continued)

(58) Field of Classification Search
CPC .... F04D 17/12; F04D 17/122; F04D 29/4206; F04D 29/4213; F04D 29/44; F04D 29/444
See application file for complete search history.

(56) References Cited

U.S. PATENT DOCUMENTS 4,725,196 A * 2/1988 Kaneki ..... F04D 29/104 415/100
5,791,159 A * 8/1998 Aicher ..... F04D 17/14 62/510

(Continued)

FOREIGN PATENT DOCUMENTS

JP 55090799 U * 6/1980
JP S57206800 A 12/1982

(Continued)

OTHER PUBLICATIONS

Extended European Search Report in corresponding European Application No. 18 754 032.3, dated Sep. 18, 2019 (8 pages).

(Continued)

*Primary Examiner* — Topaz L. Elliott
(74) *Attorney, Agent, or Firm* — Osha Bergman Watanabe & Burton LLP

(57) ABSTRACT

A centrifugal compressor includes an impeller, a return channel including a return vane for guiding a main stream of a fluid to be compressed by the impeller from an outer side of a main shaft of the impeller in a radial direction toward an inner side, stages of compressor units connected to a downstream side of the return channel and including a first bent channel for changing the main stream to a direction along the main shaft, and an intermediate suction channel connected to the return channel in at least one of the compressor units to merge a suctioned fluid to the main stream. The intermediate suction channel includes a chamber having a scroll shape and passing the suctioned fluid (Continued)

therethrough, and an inlet guide vane for guiding the suctioned fluid. The inlet guide vane is integrated with the return vane in the connected return channel.

3 Claims, 9 Drawing Sheets

(52) U.S. Cl.
CPC ..... *F04D 29/4213* (2013.01); *F04D 29/44* (2013.01); *F04D 29/444* (2013.01)

(56) References Cited

U.S. PATENT DOCUMENTS

| | | | | |
|---|---|---|---|---|
| 10,400,788 | B2 * | 9/2019 | Nakaniwa | F04D 17/122 |
| 2016/0327056 | A1 * | 11/2016 | Nakaniwa | F04D 29/444 |
| 2018/0172025 | A1 * | 6/2018 | Koga | F04D 29/462 |
| 2020/0300251 | A1 * | 9/2020 | Yamashita | F04D 29/444 |
| 2020/0300252 | A1 * | 9/2020 | Yamashita | F04D 17/125 |
| 2021/0115943 | A1 * | 4/2021 | Koga | F04D 17/12 |

FOREIGN PATENT DOCUMENTS

| | | | | |
|---|---|---|---|---|
| JP | 06257590 | A | * | 9/1994 |
| JP | H0979192 | A | | 3/1997 |
| JP | H09144698 | A | | 6/1997 |
| JP | 2016056741 | A1 | | 4/2016 |
| WO | 2010-084422 | A2 | | 7/2010 |

OTHER PUBLICATIONS

International Search Report issued in corresponding International Patent Application No. PCT/JP2018/005737, dated May 1, 2018 (4 pages).
Written Opinion issued in corresponding International Patent Application No. PCT/JP2018/005737, dated May 1, 2018 (10 pages).

* cited by examiner

PRIOR ART

PRIOR ART

PRIOR ART

PRIOR ART

CENTRIFUGAL COMPRESSOR WITH INTERMEDIATE SUCTION CHANNEL

FIELD

The present invention relates to a centrifugal compressor including an intermediate suction channel.

BACKGROUND

For a multi-stage centrifugal compressor, a technology for merging an injected stream from an intermediate suction channel to a main stream flowing into the second compressor stage and subsequent compressor stages has been known (for example, see Patent Literature 1 and Patent Literature 2).

CITATION LIST

Patent Literature

Patent Literature 1: Japanese Unexamined Patent Application Publication No. 57-206800

Patent Literature 2: Japanese Unexamined Patent Application Publication No. 09-144698

SUMMARY

Technical Problem

In a centrifugal compressor having an intermediate suction channel, it is preferable to set a gas inflow angle substantially the same as an inlet angle to the return guide vanes. In the technology disclosed in Patent Literature 1, a partitioning wall that is provided on the inner surface of the casing provides a partition between a second passage and a passage leading from an impeller in a prior stage, in a manner extending to an inlet portion that leads to the return vanes. In this manner, the gas inflow angle is set substantially the same as the inlet angle to the return guide vanes. Furthermore, provided in the technology disclosed in Patent Literature 2 is a partitioning wall that is engaged with the return vanes that are inside of a passage for an injected stream, that is positioned, in the rotational axial direction, where the injected stream is merged with the main stream, and that is installed, in the radial direction, in such a manner that the main stream and the injected stream are separated thereby across a range from the upstream side of the front edges of the return vanes to a predetermined position on the inner circumferential side of the front edges of the return vanes. With such a structure, the main stream and the injected stream are merged after these streams are sufficiently decelerated by the return vanes, and the velocities and the directions of the streams in the merging section are matched.

Furthermore, if the difference between the total pressure in the intermediate suction channel and the total pressure in the return channel is large, the total pressure in the inlet of the intermediate suction channel also becomes different from the total pressure in the return channel. Therefore, it becomes difficult to keep the pressure balance between the pressure in the intermediate suctioning inlet, and the pressures in the compressor inlet and outlet, despite such a pressure balance is one of compressor conditions that need to be guaranteed. Furthermore, because fluids with different total pressures flow into the subsequent compressor stage, the performance of the compressor stage may deteriorate.

Therefore, in a centrifugal compressor with an intermediate suction channel, it is preferable to keep the total pressure in the intermediate suction channel at a level substantially the same as the total pressure in the return channel.

Still furthermore, it is preferable to keep the entire diameter of the casing small, and to reduce the cost of the centrifugal compressor.

The present invention is intended to solve the technical problems described above, and an object of the present invention is to provide a centrifugal compressor capable of keeping the total pressure in the intermediate suction channel at a level substantially the same as the total pressure in the return channel so that the operating efficiency is improved, and of achieving a size reduction.

Solution to Problem

To achieve the object described above, a centrifugal compressor of the present invention includes an impeller configured to be rotated about a main shaft; a return channel including a return vane for guiding a main stream of a fluid to be compressed by the impeller from an outer side of the main shaft in a radial direction toward an inner side in the radial direction with respect to the impeller; a plurality of stages of compressor units connected to a downstream side of the return channel and including a first bent channel for changing a direction of the main stream to a direction along the main shaft; and an intermediate suction channel connected to the return channel in at least one of the plurality of stages of compressor units to merge a suctioned fluid to the main stream. The intermediate suction channel includes a chamber which has a scroll shape in a view from an axial direction of the main shaft and through which the suctioned fluid suctioned from a suction port for suctioning the fluid passes, and includes an inlet guide vane for guiding the fluid suctioned from the suction port and passing through the chamber to the impeller, and the inlet guide vane is integrated with the return vane in the connected return channel.

With such a structure, it is possible to keep the total pressure in the intermediate suction channel and the total pressure in the return channel can be kept at levels that are substantially the same so that the operating efficiency is improved, and to achieve a size reduction.

In the centrifugal compressor of the present invention, the intermediate suction channel has a partitioning wall by which the intermediate suction channel is partitioned from the return channel, and a thickness of the partitioning wall in the direction along the main shaft is thinner from the outer side in the radial direction toward the inner side in the radial direction, in a sectional view along the main shaft.

With such a structure, the inlet guide vane integrated with the return vane can guide the suctioned fluid to the impeller without disturbing the flow of the main stream.

In the centrifugal compressor of the present invention, a front end portion of the partitioning wall is positioned in middle between a second bent channel that is an inlet portion of the return channel and the first bent channel.

With such a structure, it is possible to keep the total pressure in the intermediate suction channel and the total pressure in the return channel at levels that are substantially the same so that the operating efficiency is improved, and to achieve a size reduction.

In the centrifugal compressor of the present invention, the chamber of the intermediate suction channel fits inside an external diameter of a casing.

With such a structure, it is possible to use the intermediate suction channel including the inlet guide vane integrated with the return vane without increasing the size of the centrifugal compressor.

Advantageous Effects of Invention

According to the present invention, it is possible to keep the total pressure in the intermediate suction channel and the total pressure in the return channel at levels that are substantially the same so that the operating efficiency is improved, and to achieve a size reduction.

DESCRIPTION OF EMBODIMENTS

An embodiment of the present invention will now be explained in detail with reference to the appended drawings. This embodiment is, however, not intended to limit the scope of the present invention in any way. The elements described in the embodiment below include those that can be easily replaceable by those skilled in the art, or those that are substantially the same. Furthermore, the elements described below may be combined as appropriate, and, when the embodiment is described in plurality, such embodiments may also be combined.

Figure 1:
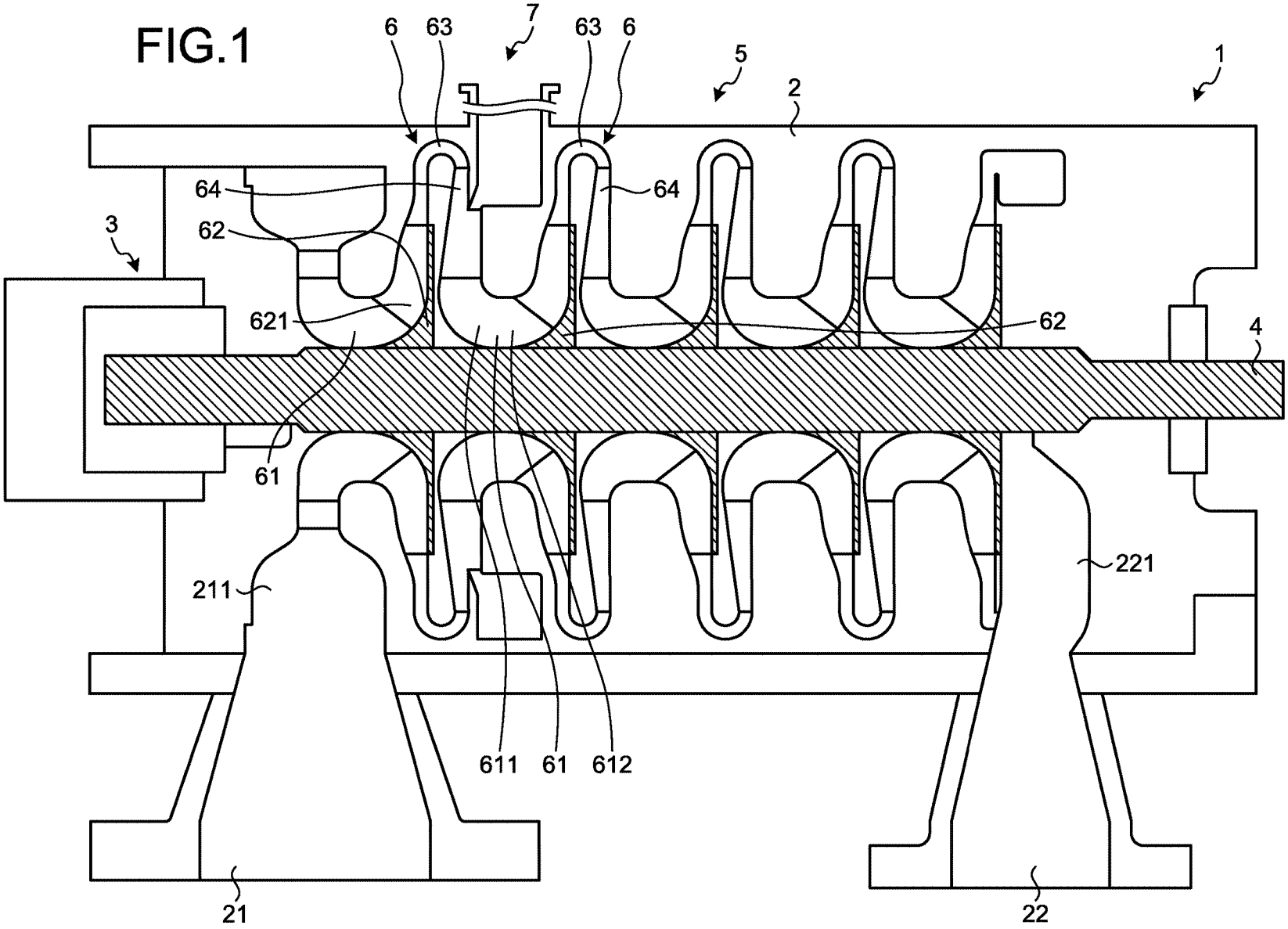
FIG. 1 is a sectional view illustrating a general structure of a compressor according to an embodiment.

A compressor (centrifugal compressor) 1 according to the embodiment will now be explained briefly with reference to FIG. 1. FIG. 1 is a sectional view illustrating a general structure of a compressor according to the embodiment. The compressor 1 is a centrifugal one-axis multi-stage compressor. The compressor 1 includes a casing 2, a bearing section 3, a main shaft 4, and a compressing section 5.

The casing 2 is a housing in which the bearing section 3, the main shaft 4, and the compressing section 5 are housed. The casing 2 has a suction port 21 and a discharge port 22. The suction port 21 suctions a fluid into the casing 2 via a suction channel 211. The suction channel 211 is a fluid channel between the suction port 21 and the compressing section 5. The discharge port 22 discharges the fluid from the casing 2 via a discharge channel 221. The discharge channel 221 is a fluid channel between the discharge port 22 and the compressing section 5. Inside the casing 2, a channel through which the fluid to be compressed is passed is provided between the suction port 21 and the discharge port 22.

The bearing section 3 rotatably supports the main shaft 4 about the axial line.

Figure 2:
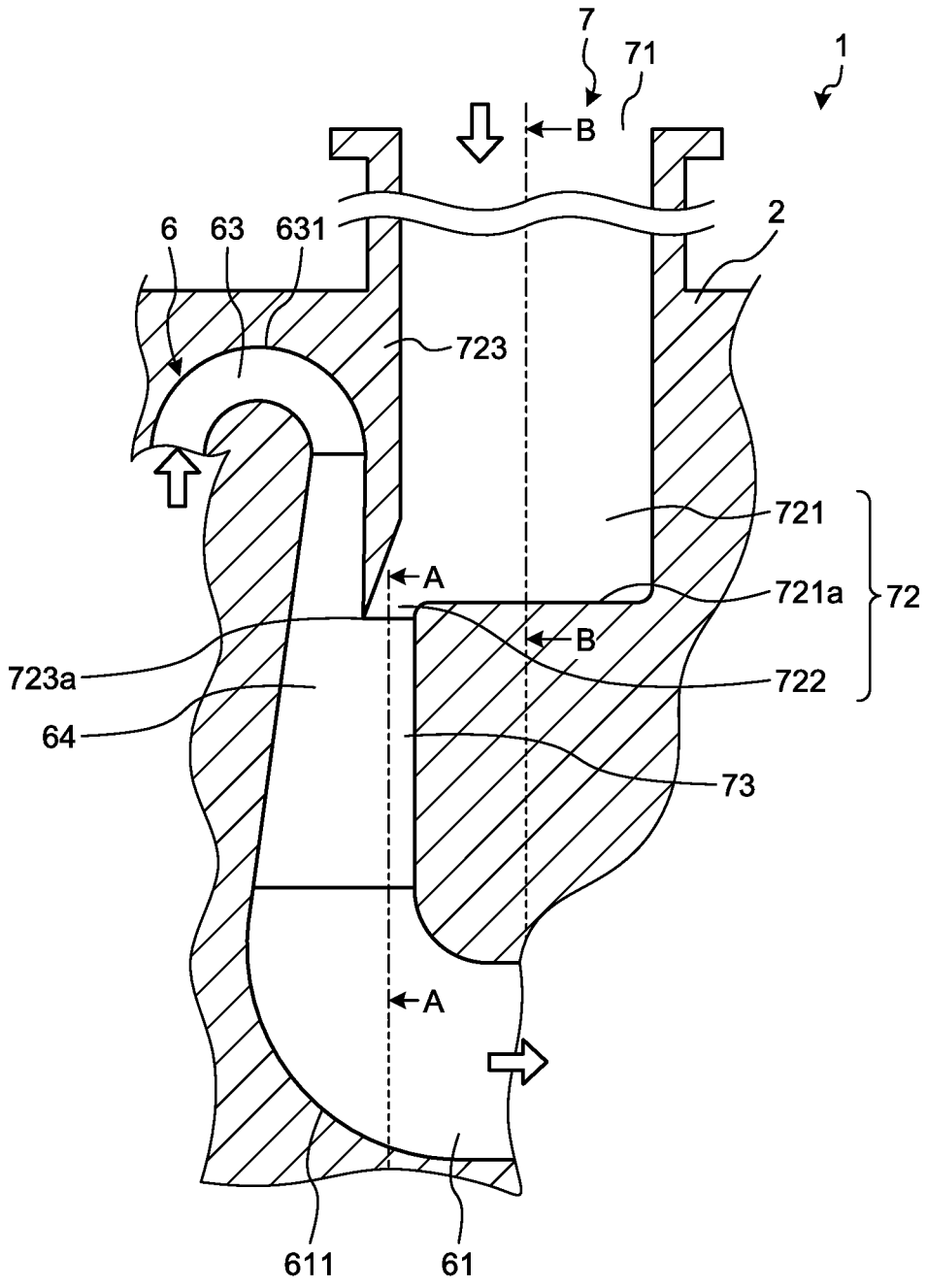
FIG. 2 is a sectional view of an intermediate suction channel in the compressor according to the embodiment.
Figure 3:
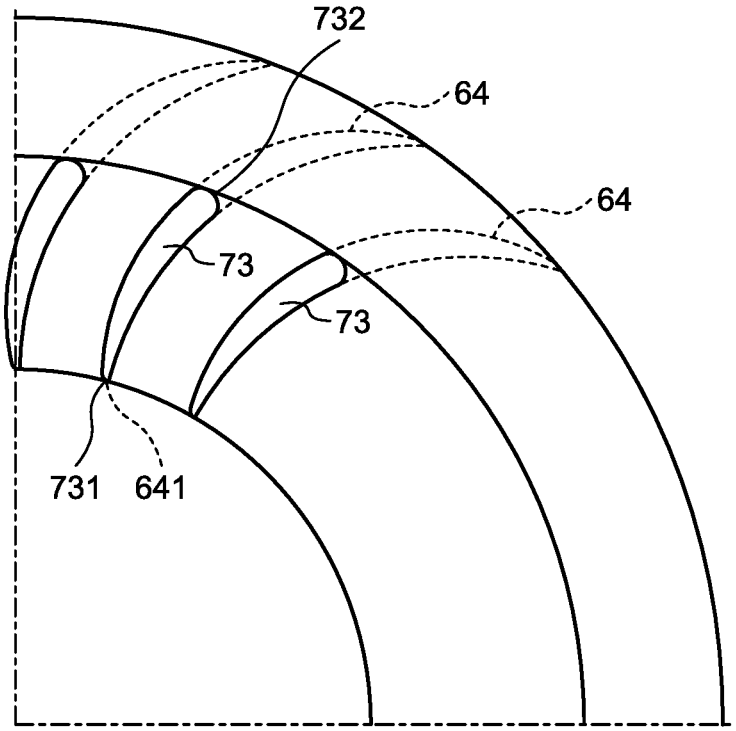
FIG. 3 is a sectional view across the line A-A in FIG. 2.

The compressing section 5 will now be explained with reference to FIGS. 1 to 3. FIG. 2 is a sectional view of an intermediate suction channel in the compressor according to the embodiment. FIG. 3 is a sectional view across the line A-A in FIG. 2. The compressing section 5 compresses the fluid suctioned from the suction port 21, and discharges the fluid from the discharge port 22. The compressing section 5 includes a plurality of compressor units 6. In this embodiment, the compressing section 5 includes five stages of compressor units 6.

The plurality of stages of compressor units 6 are connected serially between the suction channel 211 and the discharge channel 221. The first-stage compressor unit 6 is connected to the suction channel 211. The fifth-stage compressor unit 6 is connected to the discharge channel 221. Because the compressor units 6 all have the same structure, the second-stage compressor unit 6 that is provided with an intermediate suction unit 7 will now be explained, and explanations of the other compressor units 6 will be omitted.

The compressor unit 6 includes a first bent channel 61, an impeller 62 that is disposed in the first bent channel 61, a return channel 63 that is connected to a prior-stage compressor unit 6, and return vanes 64 that are disposed in the return channel 63.

The first bent channel 61 changes the direction in which the fluid flows by 90 degrees to a direction along the main shaft 4. The first bent channel 61 includes an upstream-side bent portion 611 and a downstream-side bent portion 612. The upstream-side bent portion 611 changes the direction in which the fluid flows to the direction along the axial direction. The downstream-side bent portion 612 changes the direction in which the fluid flows to a direction extending from the inner side to the outer side in the radial direction. The upstream side of the first bent channel 61 in the first-stage compressor unit 6 is connected to the suction channel 211, and the downstream side is connected to the return channel 63 of the second-stage compressor unit 6. The upstream side of the first bent channel 61 in each of the second- and subsequent-stage compressor units 6 is connected to the downstream side of the corresponding return channel 63, and the downstream side of the first bent channel 61 is connected to the upstream side of the return channel 63 in the subsequent-stage compressor unit 6. The fluid passed through the first bent channel 61 flows into the subsequent-stage compressor unit 6.

The impeller 62 is fixed to the main shaft 4. A large number of blades 621 are arranged on a surface of the impeller 62. The impeller 62 sends the fluid flowed into the first bent channel 61 toward the return channel 63, by rotating in a manner associated with the main shaft 4.

The return channel 63 leads the fluid from the outer side in the radial direction to the inner side in the radial direction with respect to the impeller 62 in the compressor unit 6. The return channel 63 includes a second bent channel 631 that is an inlet portion of the return channel 63. The second bent channel 631 included in the return channel 63 changes the direction of the fluid by 180 degrees to a direction from the outer side to the inner side in the radial direction. The upstream side of the return channel 63 is connected to the downstream side of the first bent channel 61 in the previous-stage compressor unit 6, and the downstream side of the return channel 63 is connected to the upstream side of the first bent channel 61. The fluid passed through the return channel 63 flows into the first bent channel 61.

The return vanes 64 guide the fluid to the impeller 62. The return vanes 64 straighten the fluid flowing through the return channel 63. More specifically, the return vanes 64 guide the fluid flowing through the return channel 63 toward the inner side in the radial direction, that is, toward the main shaft 4. The return vanes 64 are arranged at an equal interval along the circumferential direction of the return channel 63. In other words, the return vanes 64 are arranged at a predetermined interval along the rotating direction of the main shaft 4, across the entire circumference of the return channel 63. The return vanes 64 are disposed at positions separated from the return vanes 64 adjacent thereto, in the circumferential direction. The return vanes 64 are plate-like members extending along the radial directions. More specifically, the return vanes 64 have a vane shape with a curved surface. With this structure, the fluid flowed into the return channel 63 passes between the return vanes 64, and reaches the impeller 62.

The plurality of stages of compressor units 6 having such a structure make up the compressing section 5. In this embodiment, the first-stage compressor unit 6 compresses the incoming fluid from the suction channel 211, and allows the compressed fluid to flow into the second-stage compressor unit 6. The second- and the subsequent-stage compressor units 6 compress the incoming fluid from the prior-stage compressor units 6, and allows the compressed fluid to flow into the subsequent-stage compressor unit 6. The fifth-stage compressor unit 6 compresses the incoming fluid from the fourth-stage compressor unit 6, and discharges the compressed fluid out of the discharge channel 221.

Figure 4:
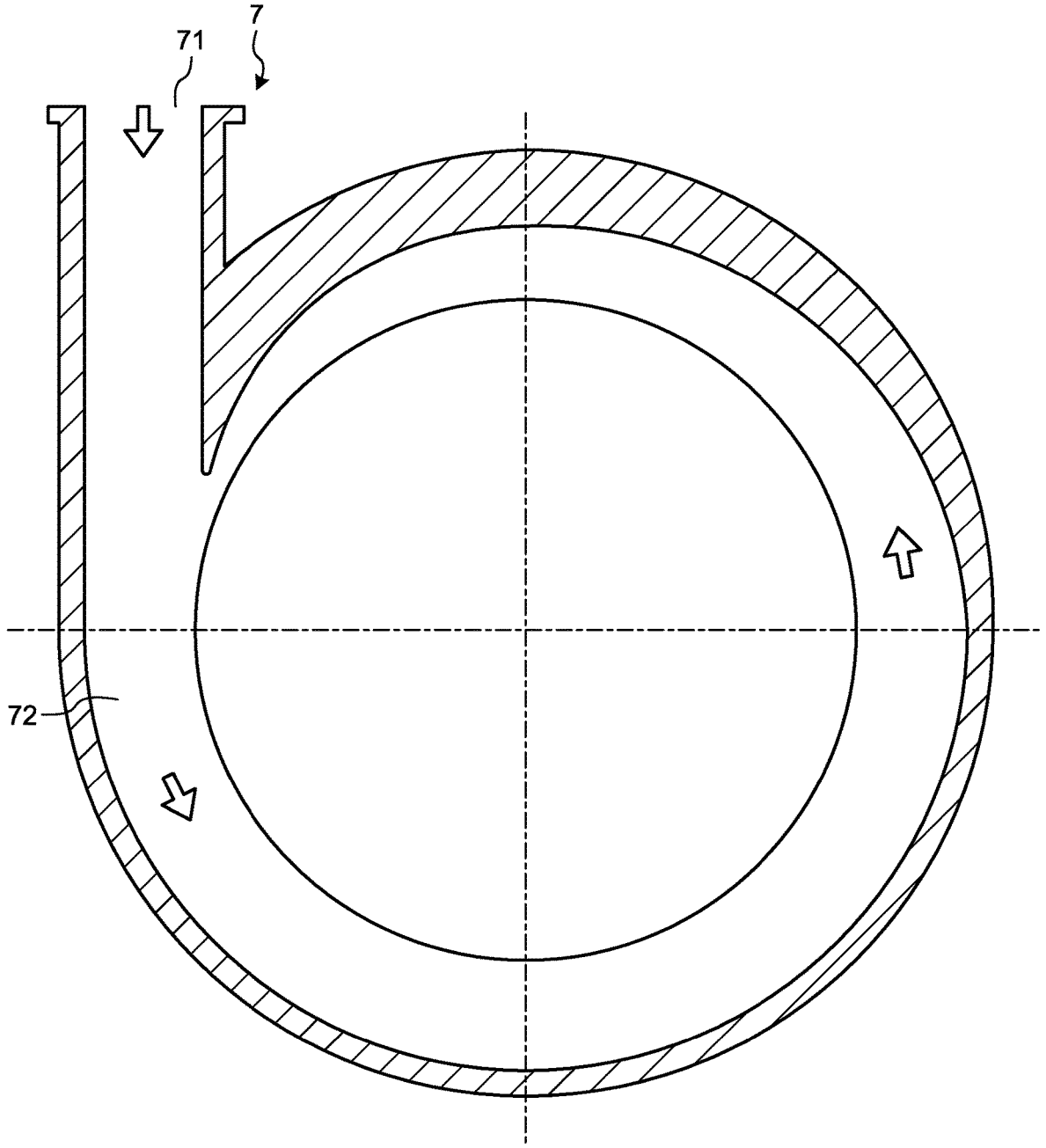
FIG. 4 is a sectional view across the line B-B in FIG. 2.

As illustrated in FIGS. 1 to 4, the intermediate suction unit 7 will now be explained. FIG. 4 is a sectional view across the line B-B in FIG. 2. The intermediate suction unit 7 merges a suctioned fluid into a main stream that is the fluid flowing through the return channel 63. In this embodiment, the intermediate suction unit 7 is connected to the second-stage compressor unit 6. The intermediate suction unit 7 includes an intermediate suction port (suction port) 71, an intermediate suction channel 72, and inlet guide vanes (IGVs) 73 that are disposed in the intermediate suction channel 72.

The intermediate suction port 71 is provided along the circumferential direction of the scroll of the intermediate suction channel 72. The intermediate suction port 71 is disposed along the outer circumference of the casing 2. The intermediate suction port 71 extends in a direction that is in parallel with the radial direction. The downstream side of the intermediate suction port 71 is connected to the upstream side of the intermediate suction channel 72. As illustrated in FIG. 4, in this embodiment, the intermediate suction port 71 is provided on the upper left side of the intermediate suction channel 72, in a manner facing upwards, in a view from the axial direction of the main shaft 4 (hereinafter, referred to as "a view from the axial direction").

The intermediate suction channel 72 is connected to the return channel 63. The intermediate suction channel 72 merges the fluid suctioned via the intermediate suction port 71 to the main stream. The intermediate suction channel 72 has a scroll shape in a view from the axial direction. The entire scroll of the intermediate suction channel 72 fits inside the external diameter of the casing 2. The intermediate suction channel 72 includes a chamber 721 and an inflow channel 722.

The chamber 721 has a scroll shape. In this embodiment, the chamber 721 forms a scroll in the counterclockwise direction, in a view from the axial direction. The fluid suctioned from the intermediate suction port 71 passes through the chamber 721. The chamber 721 is communicated with the intermediate suction port 71 on the outer side in the radial direction. The chamber 721 is communicated with the inflow channel 722 on the inner side in the radial direction. A side wall 721*a* on the inner side of the chamber 721 in the radial direction is positioned slightly outer side of front edges 732 of the IGVs 73 in the radial direction.

The inflow channel 722 communicates the inner side of the chamber 721 in the radial direction with the return channel 63.

A side wall (partitioning wall) 723 of the intermediate suction channel 72 partitions the return channel 63 and the intermediate suction channel 72. The side wall 723 has a shape with a thickness becoming smaller toward the inner side in the radial direction from the outer side in the radial direction, in the sectional view along the main shaft. In other words, the side wall 723 has a wedged shape, in the sectional view along the main shaft. The radial inner end (front end) 723*a* of the side wall 723 is positioned at the center of the return vanes 64 in the radial direction. In other words, the intermediate suction channel 72 is connected to the return channel 63 at the center of the return vanes 64. The connected portion where the return channel 63 and the intermediate suction channel 72 are connected is positioned in the middle between the second bent channel 631 included in the return channel 63 and the first bent channel 61.

The IGVs 73 guide the fluid passed through the suction chamber 721 to the impeller 62 in the compressor unit 6. The IGVs 73 are integral with the return vanes 64. Being integral includes a configuration in which the IGVs 73 and the return vanes 64 are integrated, and a configuration in which the IGVs 73 and the return vanes 64 are combined into an integration. The IGVs 73 and the return vanes 64 are arranged at the same position and the same interval along the circumferential direction. Each rear end IGV 73 has a vane shape following the vane shape of the corresponding return vane 64. More specifically, the IGV 73 has the same shape as that of a part of the return vane 64 from a rear edge 641 to the center thereof. The front edge 732 of the IGV 73 has a rounded front end portion. The rear edge 731 of the IGV 73 and the rear edge 641 of the return vane 64 are positioned at the same position in a view from the axial direction. The IGVs 73 and the return vane 64 are arranged in a manner overlapping each other in a view from the axial direction.

The side wall 723 of the intermediate suction channel 72 is not interposed between the IGVs 73 and the return vanes 64 that are integrated. In other words, end surfaces of the vane surfaces of the IGVs 73 are in close contact with those of the return vanes 64 in the axial direction.

Actions of and effects achieved by the compressor 1 will now be explained.

The compressor 1 rotates the impellers 62 in all of the compressor units 6, in a manner associated with the main shaft 4. In this manner, the fluid is suctioned from the suction port 21, and is caused to flow into the first bent channel 61 of the compressor unit 6 via the suction channel 211. The pressure of the fluid is then boosted by the impeller 62. The fluid is then sent out from the first bent channel 61 into the return channel 63 in the subsequent-stage compressor unit 6.

The compressor 1 suctions the fluid from the intermediate suction channel 72 in the intermediate suction unit 7. The suctioned fluid is straightened by the IGVs 73 while passing through the intermediate suction channel 72, and is merged with the main stream along the entire circumference.

The fluid having merged with the fluid suctioned by the intermediate suction unit 7 flows into the first bent channel 61. The pressure of the fluid is then boosted by the impeller 62.

As a result, the compressor 1 discharges the fluid compressed by the plurality of stages of compressor units 6 out of the discharge port 22 in the discharge channel 221.

As explained above, according to the embodiment, the return channel 63 and the intermediate suction channel 72 are connected to each other at a position that is separated from the second bent channel 631 included in the return channel 63, and is also separated from the bent portion 611 on the upstream side of the first bent channel 61. In this manner, according to the embodiment, the hub-side static pressure in the return channel 63 and the shroud-side static pressure in the intermediate suction channel 72 are set to levels that are substantially the same.

Figure 5:
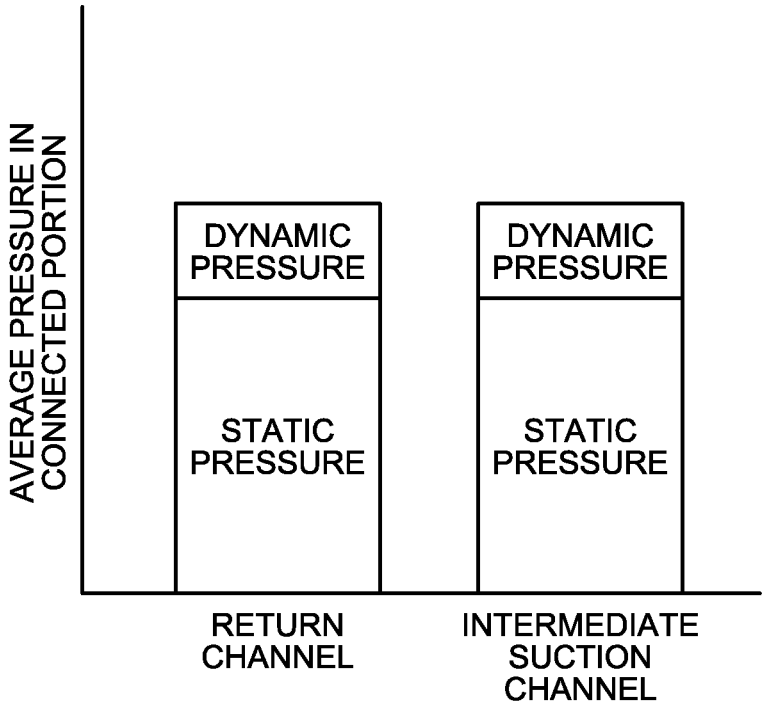
FIG. 5 is a graph illustrating one example of fluid pressures.

The pressure in the return channel 63 and the pressure in the intermediate suction channel 72 will now be explained with reference to FIG. 5. FIG. 5 is a graph illustrating one example of fluid pressures. In the upstream-side bent portion 611 of the first bent channel 61, the hub-side static pressure is high, and the shroud-side static pressure is low. However, because the connected portion between the return channel 63 and the intermediate suction channel 72 is separated from the upstream-side bent portion 611, the static pressure in the return channel 63 that is on the hub side and the static pressure in the intermediate suction channel 72 that is on the shroud side are brought to levels that are substantially the same. Therefore, as illustrated in FIG. 5, in this embodiment, the static pressure in the return channel 63 and the static pressure in the intermediate suction channel 72 are at levels that are substantially the same.

Furthermore, in the portion where the return channel 63 and the intermediate suction channel 72 are connected to each other, the velocities of the flows in the respective channels are designed to be equal. In this manner, if the same dynamic pressures are added to the static pressure in the return channel 63 and the static pressure in the intermediate suction channel 72, and the total pressure in the return channel 63 and the total pressure in the intermediate suction channel 72 are calculated, the resultant total pressures can be calculated to be substantially at the same level, as illustrated in FIG. 5.

In the manner described above, according to the embodiment, the total pressure in the return channel 63 and the total pressure in the intermediate suction channel 72 can be brought to levels that are substantially the same.

In the embodiment, because the total pressure in the return channel 63 and the total pressure in the intermediate suction channel 72 are substantially at the same level, the pressure balance between the inlet and the outlet of the compressor 1, and the intermediate suctioning inlet is maintained. Furthermore, according to the embodiment, because the fluids with no difference in the total pressure flow into the subsequent-stage compressor unit 6, it is possible to maintain the performance of the impeller 62 of the subsequent-stage compressor unit 6. In the manner described above, according to the embodiment, it is possible to improve the operating efficiency of the compressor 1.

Figure 6:
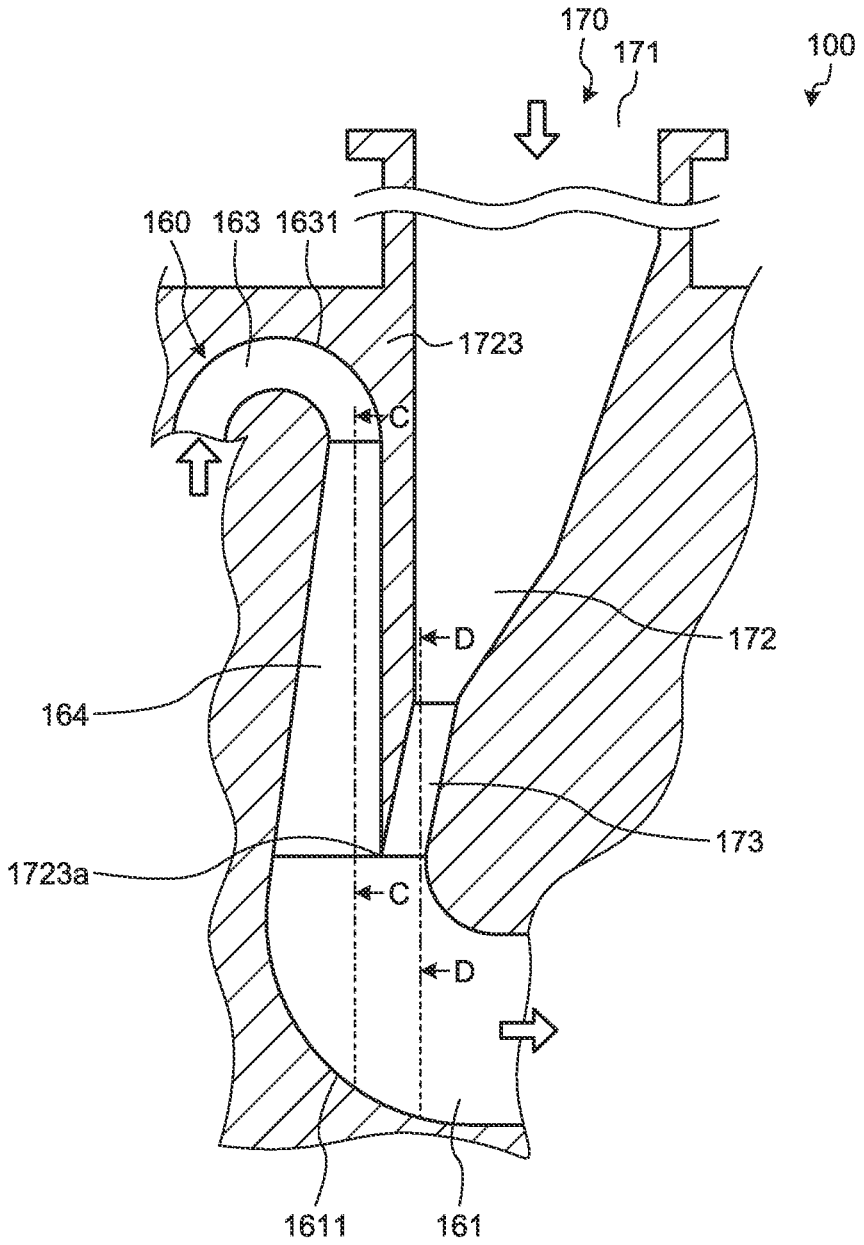
FIG. 6 is a sectional view of an intermediate suction channel in a conventional compressor.
Figure 7:
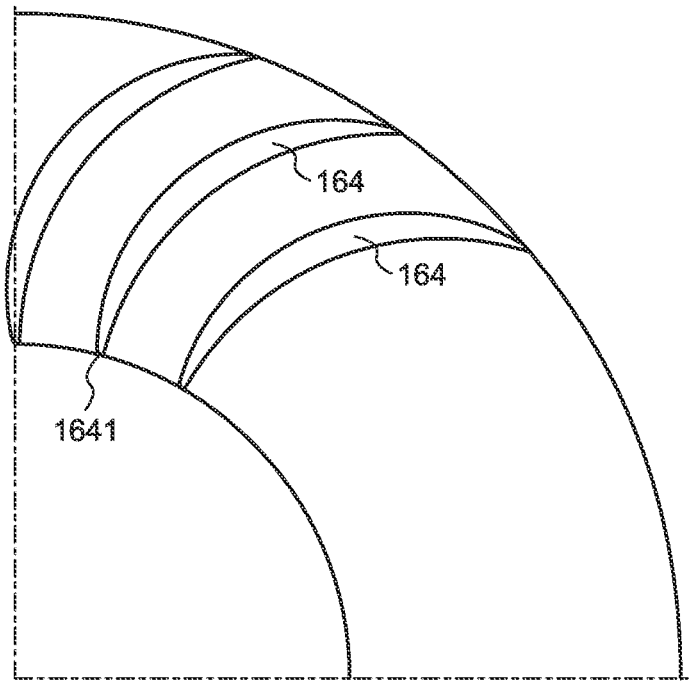
FIG. 7 is a sectional view across the line C-C in FIG. 6.
Figure 8:
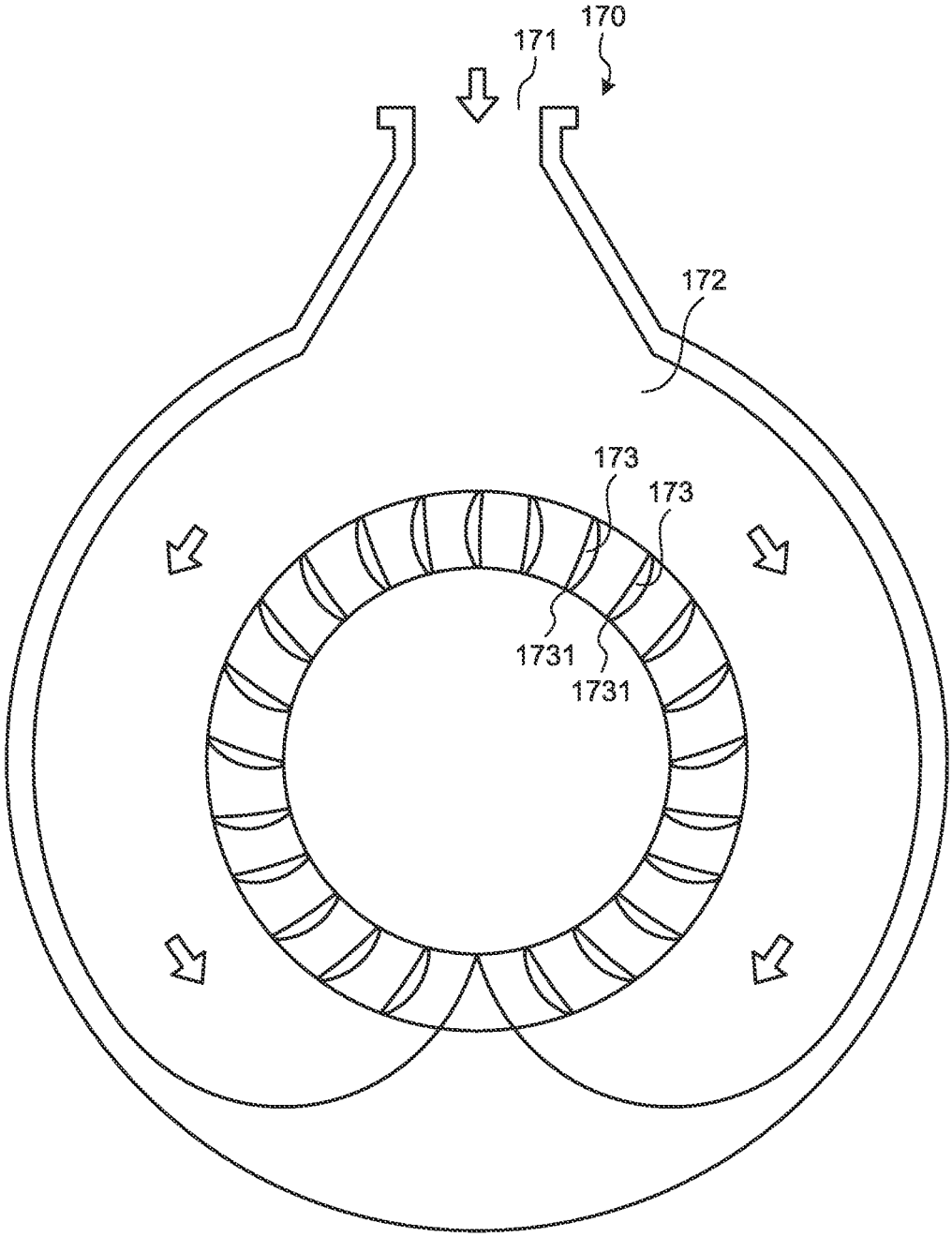
FIG. 8 is a sectional view across the line D-D in FIG. 6.
Figure 9:
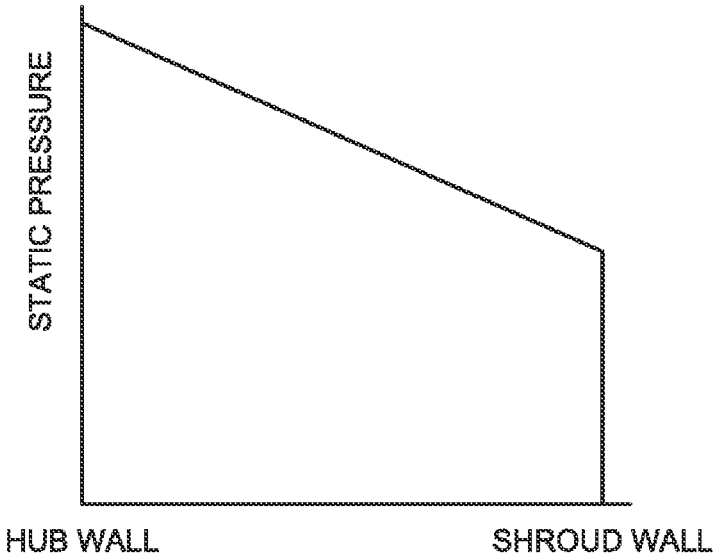
FIG. 9 is a graph illustrating one example of a conventional fluid pressure distribution.
Figure 10:
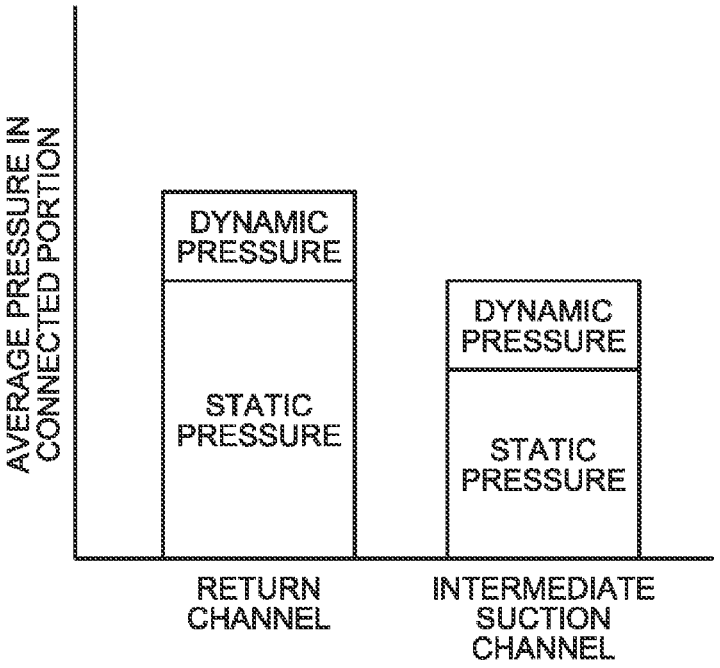
PRIOR ART FIG.10
FIG. 10 is a graph illustrating one example of conventional fluid pressures.

A conventional compressor 100 will now be explained with reference to FIGS. 6 to 10. FIG. 6 is a sectional view of an intermediate suction channel in a conventional compressor. FIG. 7 is a sectional view across the line C-C in FIG. 6. FIG. 8 is a sectional view across the line D-D in FIG. 6. FIG. 9 is a graph illustrating one example of a conventional fluid pressure distribution. FIG. 10 is a graph illustrating one example of conventional fluid pressures. As illustrated in FIG. 6, in the conventional compressor 100, the structure of the connected portion between a return channel 163 and an intermediate suction channel 172 is different from that in the compressor 1.

This compressor unit 160 has the same structure as the compressor unit 6 according to the embodiment. More specifically, the return channel 163 has the same structure as that of the return channel 63 according to the embodiment. As illustrated in FIG. 7, return vanes 164 have the same structure as the return vanes 64 according to the embodiment. In an intermediate suction unit 170, the intermediate suction channel 172 and IGVs 173 are different from those in the intermediate suction unit 7. As illustrated in FIG. 8, the intermediate suction channel 172 is line-symmetric in a view from the axial direction. The IGVs 173 have different vane shapes depending on their positions in circumferential direction. More specifically, as a pair of IGVs 173 that are symmetric with respect to the axis of symmetry, vanes each having a line-symmetric vane shape with respect to the other are provided. Therefore, the IGVs 173 and the return vanes 164 have different vane shapes, and are arranged at different positions. As illustrated in FIG. 6, a side wall 1721 of the intermediate suction channel 172 is interposed between the IGVs 173 and the return vanes 164. A radial inner end 173*a* of the side wall 1721 is positioned at a position matching the position of the rear edges 1641 of the return vanes 164 and the rear edges 1731 of the IGVs 173 in the radial direction.

Furthermore, the radial inner end 173*a* of the side wall 1721 is near a bent portion 1611 on the upstream-side of a bent channel 161. In other words, the connected portion between the return channel 163 and the intermediate suction channel 172 is near the bent portion 1611 on upstream side of the bent channel 161. As a result, as illustrated in FIG. 9, the static pressure in the return channel 163 on the hub side becomes higher, and the static pressure of the intermediate suction channel 172 on the shroud side becomes lower.

Furthermore, the total pressure in the return channel 163 and the total pressure in the intermediate suction channel 172 calculated by adding the same dynamic pressure to the static pressure in the return channel 163 and the static pressure of the intermediate suction channel 172 are as illustrated in FIG. 10. In other words, the total pressure in the intermediate suction channel 172 becomes lower than the total pressure in the return channel 163. If the difference between the total pressure in the return channel 163 and the total pressure in the intermediate suction channel 172 is large, the total pressure in the inlet of the intermediate suction channel 172 becomes lower than the total pressure in the return channel 163. In such a case, it will be difficult for the conventional compressor 100 to maintain the pressure balance between the pressures in the inlet and the outlet of the compressor 100, and that in the intermediate suctioning inlet. Furthermore, in the conventional compressor 100, fluids with different total pressures may flow into the subsequent-stage compressor unit 160, and cause the performance of the subsequent-stage compressor unit 160 to deteriorate.

In addition, in the conventional compressor 100, because the vane shape of the IGVs 173 and that of the return vanes 164 are different, the sectional shapes of the vane surfaces are also different. As a result, if a configuration in which the side wall 1721 of the intermediate suction channel 172 is not interposed between the IGVs 173 and the return vanes 164 is used, the end surface of the vane surface of the IGVs 173 and the end surface of the vane surface of the return vanes 164 will be exposed to the fluid. Furthermore, the IGVs 173 positioned on one side of the axis of symmetry have vane shapes curving in a different direction from that in which the vane shape of the return vanes 164 is curved. As a result, if a configuration in which the side wall 1721 of the intermediate suction channel 172 is not interposed between the IGVs 173 and the return vanes 164 is used, the flow of the main stream becomes disturbed, and such disturbance may cause the performance of the compressor unit 160 to deteriorate.

By contrast, in the embodiment, the IGVs 73 that are integrated with the return vanes 64 can merge the suctioned fluid to the main stream and guide the fluid to the impeller 62 without disturbing the flow of the main stream.

According to the embodiment, the scroll of the intermediate suction channel 72 fits inside the external diameter of the casing 2. Therefore, with the embodiment, the intermediate suction unit 7 with the IGVs 73 integrated with the return vanes 64 can be provided without increasing the entire size.

In the embodiment, the side wall 721*a* on the inner side of the chamber 721 in the radial direction is positioned slightly on the outer side of the front edges 732 of the IGVs 73 in the radial direction. In this manner, in this embodiment, the intermediate suction unit 7 can be provided without increasing the external diameter of the casing 2. In the manner described above, according to the embodiment, the size of the casing 2, which occupies a large portion of the cost of the compressor 1, is not increased. Therefore, it is possible to achieve a cost reduction.

By contrast, if the side wall 721*a* on the inner side of the chamber 721 in the radial direction is positioned on the outer side of the front edges 732 of the IGVs 73 in the radial direction by a large extent, the entire intermediate suction unit 7 will be positioned on the outer side in the radial direction, and the external diameter of the casing 2 will be increased.

In the embodiment, the chamber 721 of the intermediate suction channel 72 has a scroll shape. Therefore, in the embodiment, even if the inflow conditions including the flow volume of the fluid suctioned from the intermediate suction unit 7 and the number of revolutions are changed, it is possible to keep the inflow angle to the front edges 732 of the IGVs 73 to a predetermined angle in the circumferential direction of the scroll. In this manner, in the embodiment, even if the inflow conditions of the suctioned fluid are changed, it is possible to suppress the change in the inflow angle with respect to the front edges of the return vanes 64.

By contrast, in a configuration in which the chamber 721 in the intermediate suction channel 72 does not have a scroll shape, if the inflow conditions of the suctioned fluid change, the inflow angle with respect to the front edges 732 of the IGVs 73 is also changed. As a result, the inflow angle with respect to the front edges of the return vanes 64 is also changed.

In the embodiment, the side wall 723 has a wedged shape in the sectional view along the main shaft. With this structure, it is possible to suppress generation of slip steam on the radial inner end 723*a*. In addition, by setting the thickness of the side wall 723 on the outer side in the radial direction larger than that of the radial inner end 723*a*, the strength of the side wall 723 can be enhanced. Still furthermore, by setting the thickness of the side wall 723 on the outer side in the radial direction larger than that of the radial inner end 723*a*, productions including machining and casting can be simplified.

In the embodiment, the intermediate suction unit 7 is explained to be connected to the second-stage compressor unit 6, but the embodiment is not limited thereto. The intermediate suction unit 7 may be connected to any one of the compressor units 6. The intermediate suction unit 7 may also be connected to a plurality of stages of compressor units 6.

REFERENCE SIGNS LIST

1 Compressor (centrifugal compressor)
2 Casing
4 Main shaft
5 Compressing section
6 Compressor unit
61 First bent channel
611 Upstream-side bent portion
612 Downstream-side bent portion
62 Impeller
63 Return channel
631 Second bent channel
64 Return vane
641 Rear edge
7 Intermediate suction unit
71 Intermediate suction port (suction port)
72 Intermediate suction channel
721 Chamber
722 Inflow channel
723 Side wall (partitioning wall)
723*a* Radial inner end
73 IGV (inlet guide vane)
731 Rear edge
732 Front edge

The invention claimed is:

1. A centrifugal compressor comprising:

an impeller configured to be rotated about a main shaft;

a return channel including a return vane for guiding a main stream of a fluid to be compressed by the impeller from an outer side of the main shaft in a radial direction toward an inner side in the radial direction with respect to the impeller;

a plurality of stages of compressor units connected to a downstream side of the return channel and including a first bent channel for changing a direction of the main stream to a direction along the main shaft; and an intermediate suction channel connected to the return channel in at least one of the plurality of stages of compressor units to merge a suctioned fluid to the main stream, wherein the intermediate suction channel includes a chamber which has a scroll shape in a view from an axial direction of the main shaft and through which the suctioned fluid suctioned from a suction port for suctioning the fluid passes, includes an inlet guide vane for guiding the fluid suctioned from the suction port and passing through the chamber to the impeller, and includes a partitioning wall by which the intermediate suction channel is partitioned from the return channel, a thickness of the partitioning wall in the direction along the main shaft is thinner from the outer side in the radial direction toward the inner side in the radial direction, in a sectional view along the main shaft, the inlet guide vane is integrated with the return vane in the connected return channel and has a same vane shape as a part of the return vane from a rear edge of the return vane to a center of the return vane, the partitioning wall is not interposed between the inlet guide vane and the return vane, an entire end of the inlet guide vane positioned opposite to the return vane in the direction along the main shaft is flat and perpendicular to the main shaft, a radial inner end of the partitioning wall of the intermediate suction channel is positioned at a center of the return vanes in the radial direction, and the intermediate suction channel is connected to the return channel at the center of the return vanes, and a side wall on the inner side of the chamber in the radial direction is positioned more on the outer side in the radial direction than a front edge of the inlet guide vane.

2. The centrifugal compressor according to claim 1, wherein the radial inner end of the partitioning wall is disposed between a second bent channel that is an inlet portion of the return channel and the first bent channel.

3. The centrifugal compressor according to claim 1, wherein the chamber of the intermediate suction channel fits inside an external diameter of a casing of the centrifugal compressor.

* * * * *